US006482040B1

(12) United States Patent
Brooks

(10) Patent No.: US 6,482,040 B1
(45) Date of Patent: Nov. 19, 2002

(54) ELECTRICAL SYSTEMS USING LINEAR FUSING

(76) Inventor: Dennis L. Brooks, 1313 Laredo St., Aurora, CO (US) 80010

( * ) Notice: Subject to any disclaimer, the term of this patent is extended or adjusted under 35 U.S.C. 154(b) by 0 days.

(21) Appl. No.: 09/584,953

(22) Filed: Jun. 1, 2000

(51) Int. Cl.[7] ..... H01R 13/68
(52) U.S. Cl. ..... 439/621; 439/660
(58) Field of Search ..... 439/620, 621, 439/622, 357, 358, 352, 491, 76.2, 34, 660; 361/833, 834

(56) References Cited

U.S. PATENT DOCUMENTS

| | | | |
|---|---|---|---|
| 2,740,017 | A | 3/1956 | Luce et al. |
| 2,916,720 | A | 12/1959 | Steans |
| 3,116,386 | A | 12/1963 | Sperzel |
| 3,218,413 | A | 11/1965 | Koch |
| 3,497,850 | A | 2/1970 | Gallo, Sr. |
| 3,639,882 | A | 2/1972 | Honda et al. |
| 4,221,455 | A | 9/1980 | Cairns et al. |
| 4,555,638 | A | 11/1985 | Lobe |
| 4,687,270 | A | 8/1987 | Plyler et al. |
| 4,695,112 | A | 9/1987 | Maston et al. |
| 4,726,783 | A | 2/1988 | Nakazawa et al. |
| 4,759,730 | A | 7/1988 | Sappington |
| 4,837,546 | A | 6/1989 | Bernstein |
| 4,950,169 | A | 8/1990 | Martin et al. |
| 5,229,739 | A | 7/1993 | Oh et al. |
| 5,314,347 | A | 5/1994 | Colleran et al. |
| 5,457,445 | A | 10/1995 | Su |
| 5,476,395 | A | 12/1995 | Raffles et al. |
| 5,519,586 | A | 5/1996 | Byrd |
| 5,562,502 | A | 10/1996 | Kourimsky |
| 5,563,761 | A | 10/1996 | Apa et al. |
| 5,885,098 | A | 3/1999 | Witkowski |

*Primary Examiner*—Tho D. Ta
(74) *Attorney, Agent, or Firm*—Joseph C. Herring

(57) ABSTRACT

The fusing assembly of an electrical system has communication connectors (20) (43) (55) (64), fuse sets (22) (49) (58) (72) (83) (105) or fuse units (84) (86) and bus connectors (12) (44) (55) (70). The fusing assemblies can also include bridging fixtures (45) (56) (69) (109) and communication connectors (106) (115). The preferred female electrodes are coil electrodes 914) (67) (71). The preferred fuse units and fuse sets are indexed (58) (72) (94) (100). The fusing assemblies are used in a variety of electrical systems including vehicular electrical systems.

19 Claims, 7 Drawing Sheets

ELECTRICAL SYSTEMS USING LINEAR FUSING

BACKGROUND OF THE INVENTION

This invention relates to the fused circuitry aspects of electrical systems and the components of such systems. More particularly, the invention relates to new electrical systems which can be attached to supports or have components on both sides of, e.g., a bulkhead. These systems utilize a new linear fuse unit or set and new types of bus connectors and, where desired, bridging fixtures, acting as fuse holders, and circuit connectors. Currently, the use of "plug" fuses is dominant in vehicular electrical system designs for low voltage units because, inter alia, of the greater dangers of using linear fuses in vehicles where electrodes may be exposed.

The total amount of voltage used in modern direct current vehicular fuse blocks is such that the electrical systems are informally divided into high current and low current components. The low current circuitry often uses at least two small fuse blocks to free up valuable space in one or both of the engine compartment and under the dash in the passenger compartment. The separation of the fuse block components also tends to reduce heating problems arising at the fuse electrode/fuse block electrode interface.

The heat problem is so important that automotive designers have been using higher amperage but smaller plug fuses, e.g., a 15 amp plug fuse in a 10 amp circuit, to accommodate the heat generated at the low current fuse blocks in the series wired circuitry of current and past designs.

The electrical systems of this invention are made up of a new approach to wiring systems through the use of a new linear fuse unit and/or fuse set, no fuse "blocks" as such and, preferably computer type "webbed" or "ribbon" cable coded with color, pin numbers, fasteners, etc., to identify specific circuitry. The new combinations substantially reduce both the fuse and fuse block costs, the installation costs and sizes. The use of parallel circuit wiring is preferred and, where utilized, substantially reduces the heating problems at the fuse/fuse block interface.

SUMMARY OF THE INVENTION

The new electrical systems of this invention are made up of a) linear fuses, either as a single fuse unit or as a fuse set with multiple linear fuse elements within a common enclosure; b) a bus connector, designed for use with the linear fuses and fuse sets, which also connects to a power source, e.g., a battery or a power cable; and c) and new circuit connectors and harnesses similar to those utilized with computers. Bridging fixtures and communication circuitry can be added to position fuses and for data communication, respectively, along with fuse malfunction indicators. The ampere capacity of the fuses is preferably constant within the components as shown in FIG. 1, et seq. and the use of 10 ampere fuses is preferred. The amperage capacity of the circuits within the system can be varied to provide desired utility.

The cut-away of

Figure 1:
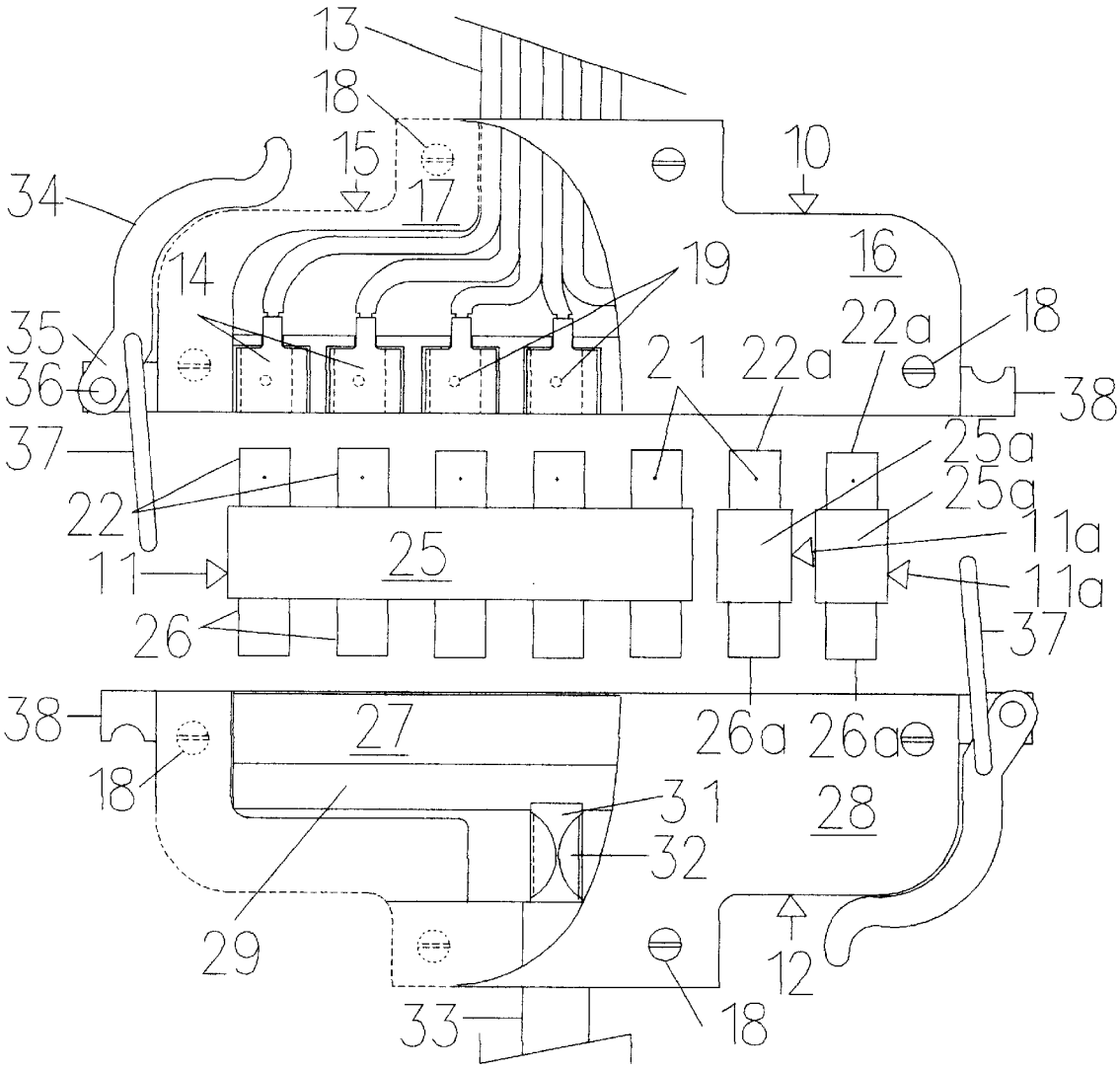
FIG. 1 is an exploded, partially cut-away view of the principal components of a preferred fusing assembly.
Figure 15:
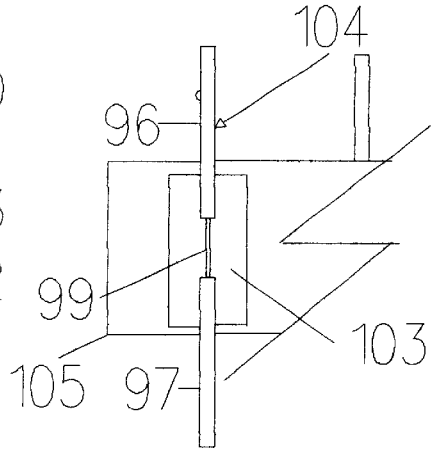

FIG. 15 depicts a portion of a fuse set with the electrodes set perpendicular to those of FIG. 1.

Figure 16:
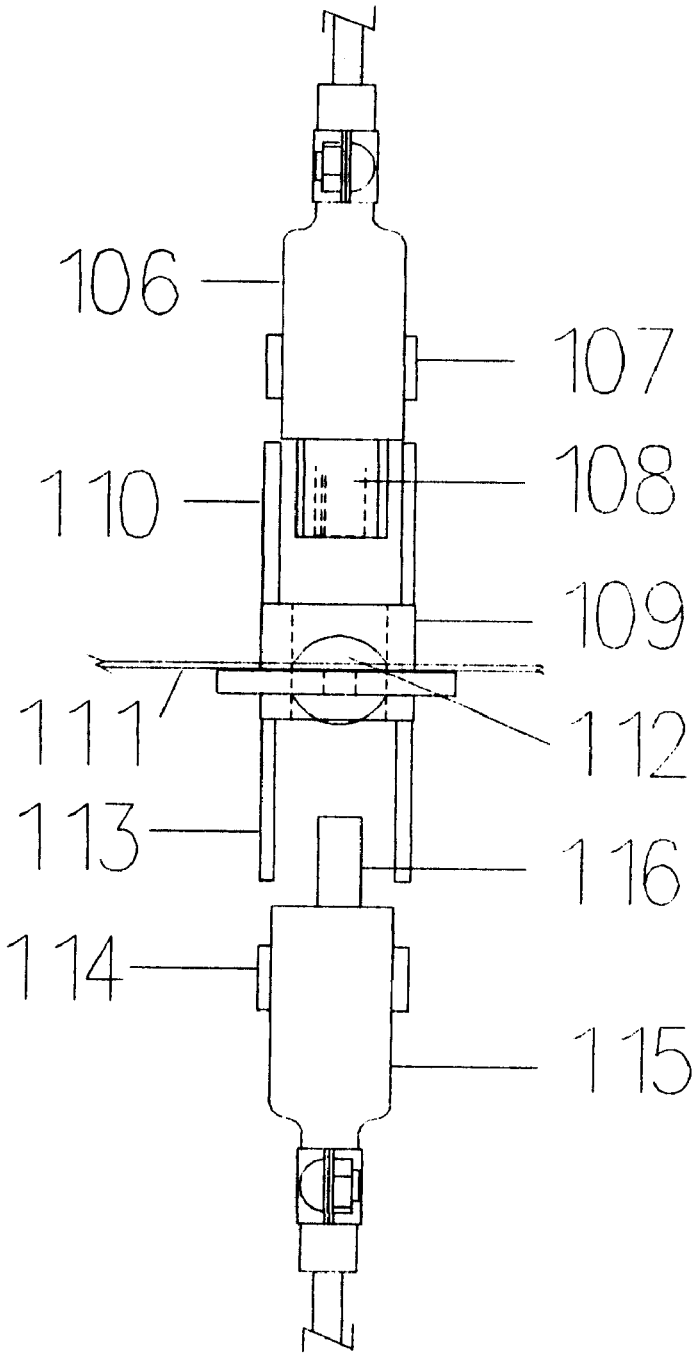

FIG. 16 is an end view of a preferred communication assembly including male and female connectors and a communication fixture.

Figure 17:
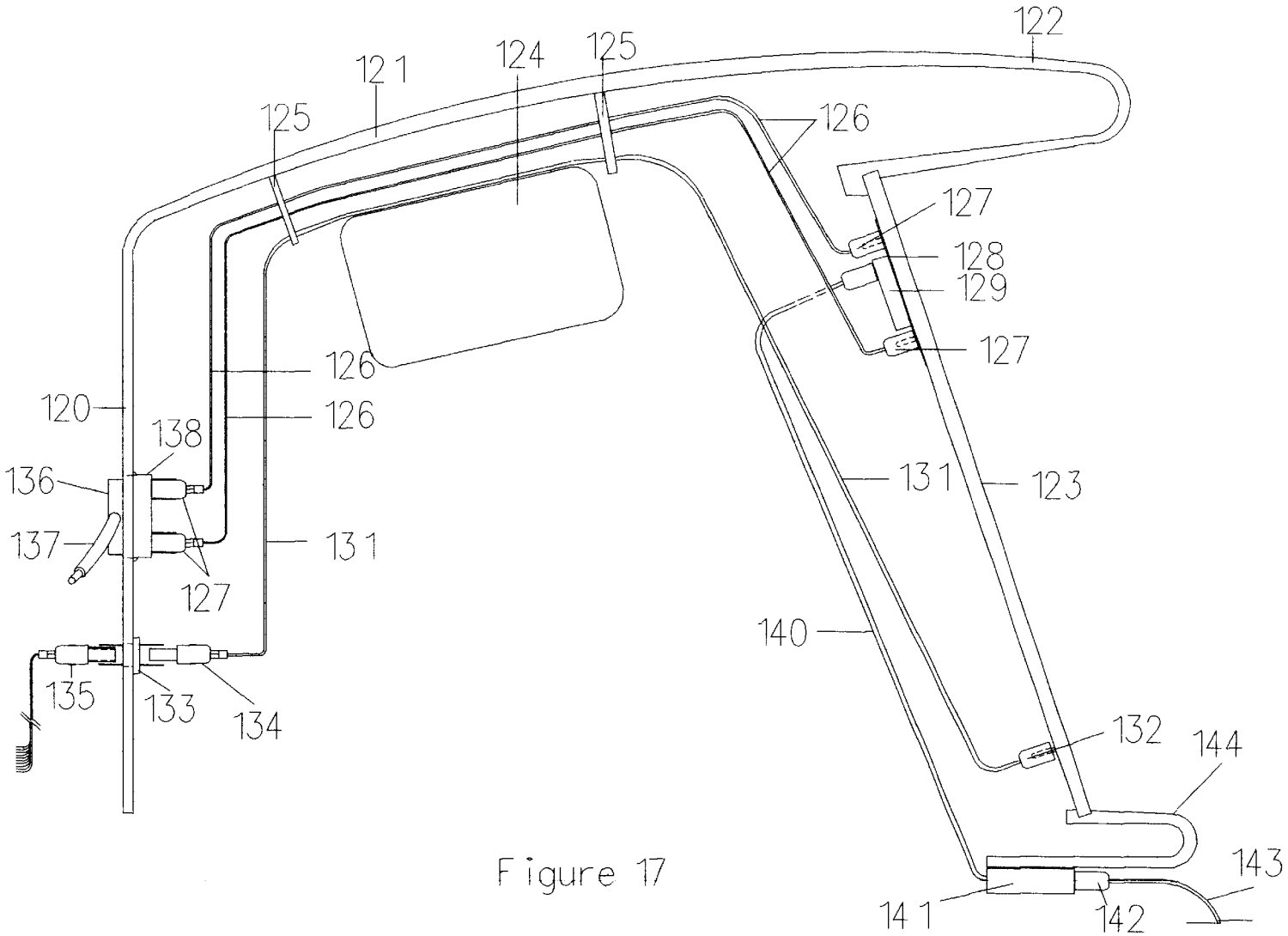

FIG. 17 is a diagrammatic view of an automotive electrical system utilizing the components described in the previous figures.

DETAILED DESCRIPTION OF THE FIGURES

The numbers utilized to identify the elements of the components used in describing the invention are not always consecutive. Modifications of elements have alphabetic suffixes.

FIG. 1 depicts a circuit connector 10, a linear fuse set 11 and fuse units 11*a* and a bus connector 12. Circuit connector 10 is connected to a webbed set of wires 13 via a set of female electrodes 14. The circuit connector 10 is made up of a shell 15 which has two halves 16 and 17 which are held together by screws 18. The female electrodes 14 have holes 19 into which can fit points 21 on the electrodes 22 on one side of the fuse set 11 and fuses 11*a*.

Fuse set 11 and fuse units 11*a* are made up of an enclosure 25 and enclosures 25*a* which contain fuse links (not shown) connecting fuse electrodes 22 and 26. Electrodes 26 and 26*a* do not have the points 21 of electrodes 22 and 22*a* for safety reasons. It is important that they more easily slip out of contact with female bus electrode 27 of bus connector 12.

Bus connector 12 has a shell 28 similar to shell 15 except as modified to support and contain bus bar base 29 and its female bus electrode 27. Bus bar base 29 attaches to the conductor 31 via clamps 32. The insulated cable 33 connects, at its other end, to a battery (not shown) or other power source. The over center lock handle 34 includes extensions 35 and pivots outward and downward on fulcrum 36 to position the "ring" 37 to be hooked under catch 38. When handle 34 is moved back to its original position adjacent shell 15, the fuse set 11 and fuse units 11*a* are locked into place within the female electrodes of circuit connector 10 and bus connector 12.

Figure 2:
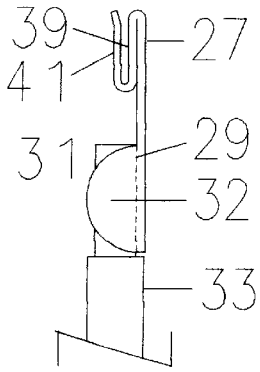
FIG. 2 is an end view of the "Y" bus connector.

FIG. 2 shows clamp elements 32 around conductor 31 of cable 33. The "Y"-shaped female connector element 27 includes a folded back wall 39 and a recurved wall 41 which receive male electrodes 26 and 26*a* (See FIG. 1).

Figure 3:
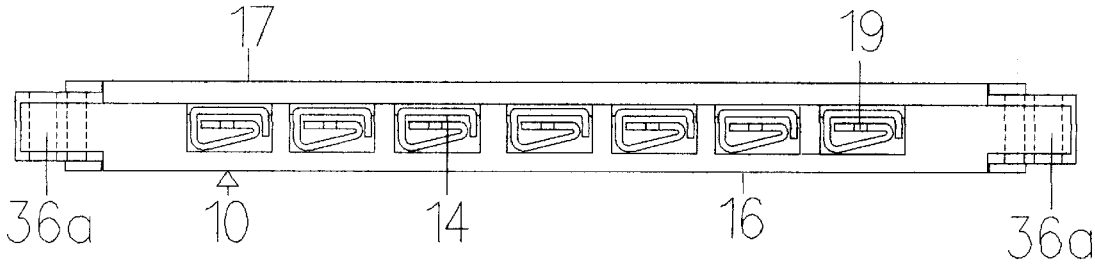
FIG. 3 is a bottom view of the circuit connector of FIG. 1.

FIG. 3 is a bottom view of circuit connector 10 of FIG. 1 with its coiled electrodes 14 positioned within shell halves 16 and 17. Coiled electrodes 14 have holes 19 and are seated within shell halves 15 and 16.

Figure 4:
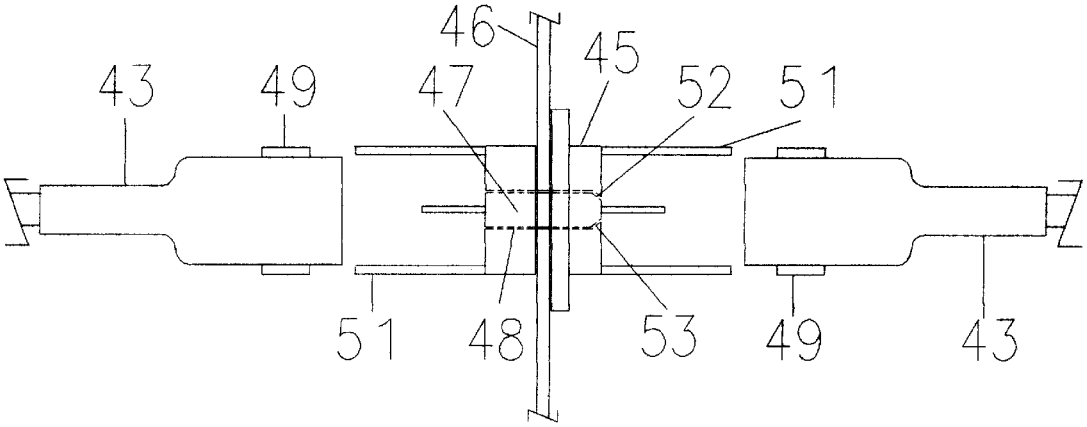
FIG. 4 is an expanded end view of a second preferred type of circuit connector, a fuse set within a bridging fixture and a bus connector which has the same form as the circuit connector.

FIG. 4 provides a side view of the modified circuit and bus connectors 43 and 44 of FIG. 3 with bridging fixture 45 astride a hole (not shown) in support panel 46. A fuse set 47 is positioned within the slot 48 in fixture 45. Each of the circuit and bus connectors 43 and 44 have opposed stops 49. The latches 51 are positioned near stops 49. When the connectors 43 and 44 seat in the fixture 45, the latches 51 will have flexed outwardly and then seated over stops 49 (See FIG. 5). Fuse set 47 has a beveled end 52 and slot 48 has a beveled projection 53 on which the beveled end 52 of fuse set 47 rests. The bevel prevents the fuse set from seating incorrectly and the connector 43 from locking. Points 21 in electrodes 22 (See FIG. 1) enable the fuse set 47 to be extracted when the circuit connector 43 is removed as a safety precaution.

In this model, a webbed cable (not shown) from a remote power source (not shown) provides the necessary electricity.

Figure 5:
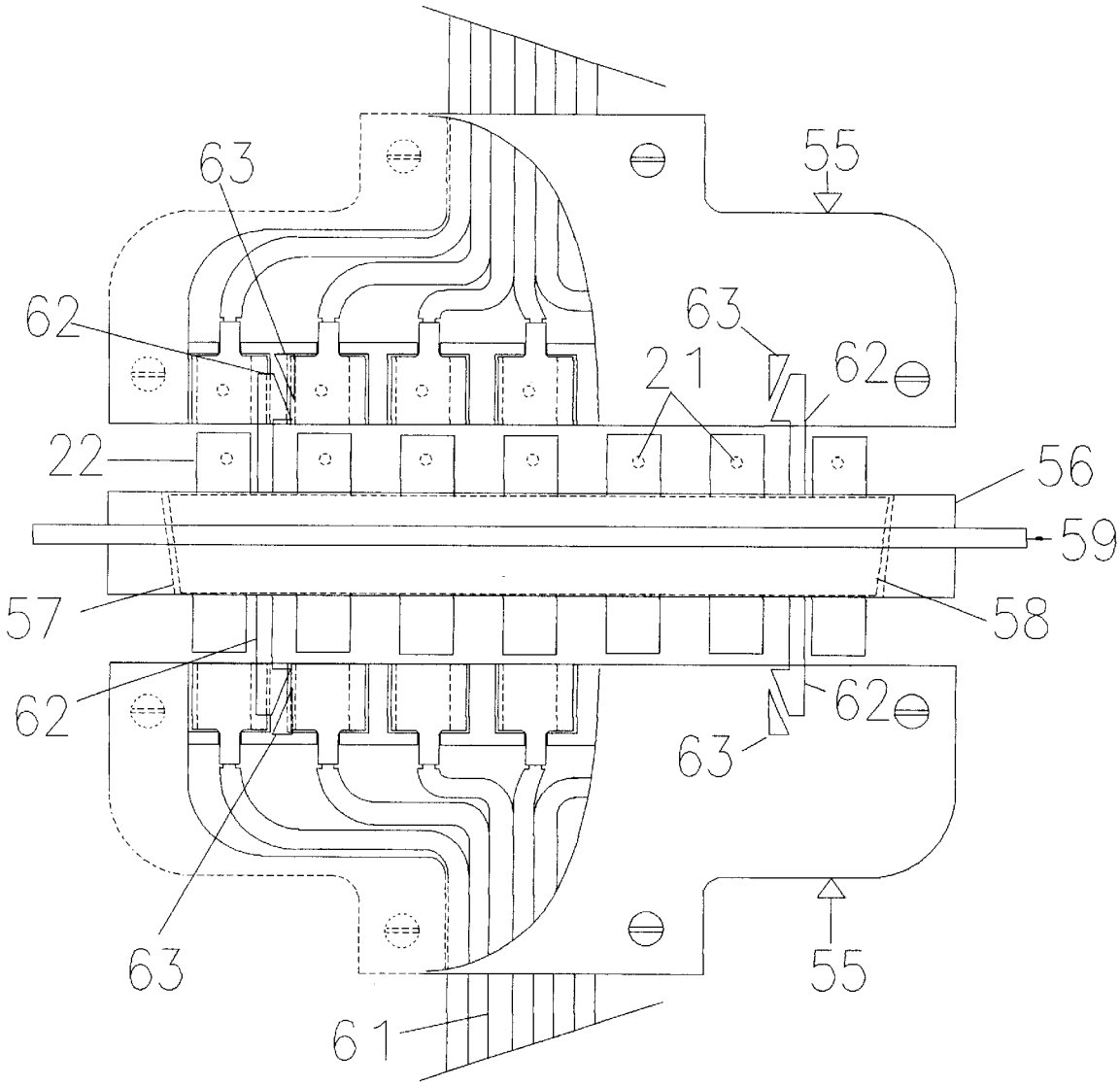
FIG. 5 is a side, partially cut-away view of a fusing assembly with another latch and lock mechanism.

FIG. 5 depicts a form of a fuse assembly for use with the connectors of FIG. 4. The electrical system panel fixture 56 has a tapered slot 57 and suspends a tapered fuse set 58 across a hole in panel 59, e.g., an automotive firewall. The lower circuit connector 55 acts as a bus connector. Electrical power is supplied through webbed cable 61. Both connectors 55 are attached to fuse set 58 by latches 62 and stops 63.

Figure 6:
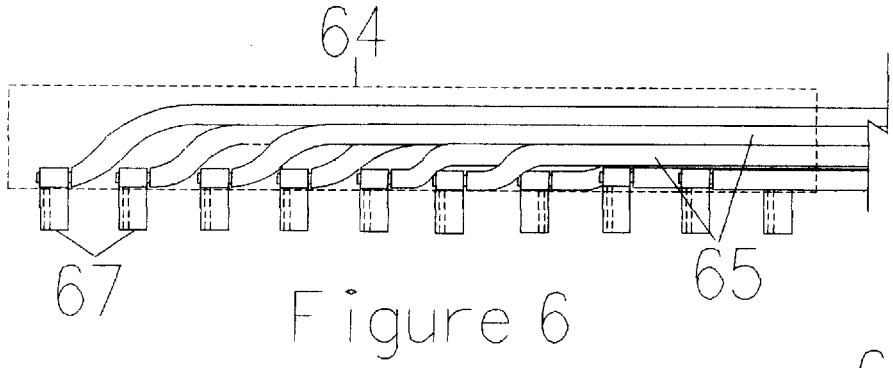
FIG. 6 is a cut-away side view of a preferred form of a circuit connector.

FIG. 6 illustrates a cutaway of a circuit connector 64 which has wires 65 of a folded webbed cable 66. Each of the wires 65 is connected to a female coiled electrode 67.

Figure 7:
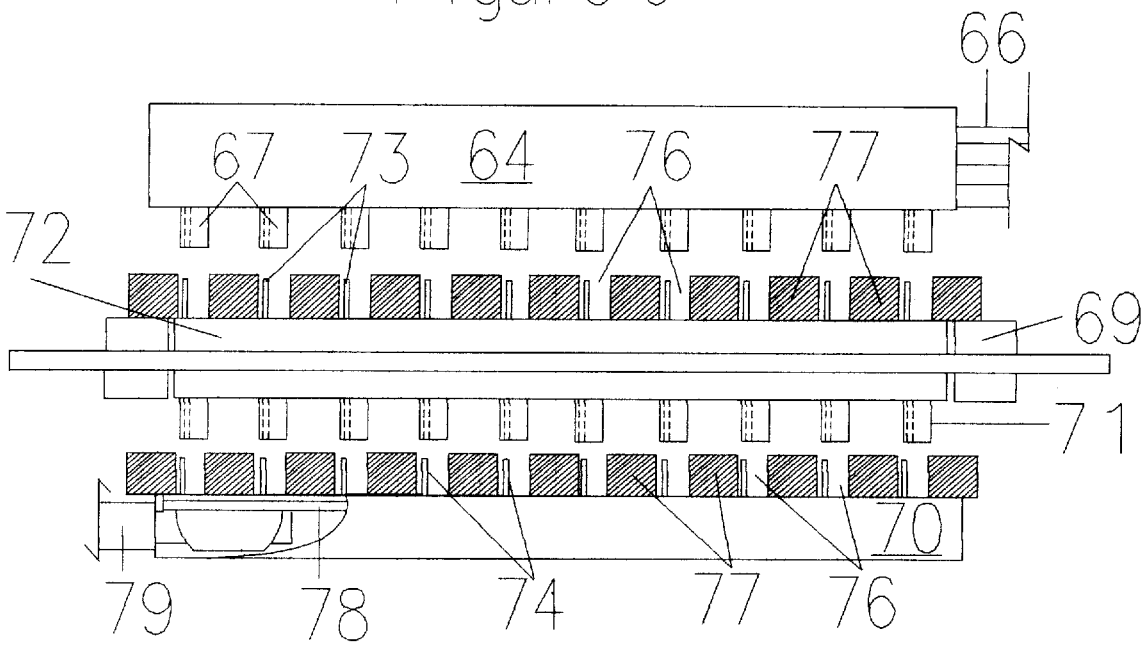
FIG. 7 is a sectional view of another form of a fusing assembly.

FIG. 7 depicts the circuit connector 64 of FIG. 6 positioned over a fixture 69 but which is, in turn, positioned over a bus connector 70. The female electrodes 67 of circuit connector 64 have the holes 19 of the female electrodes of FIG. 1, however, the female electrodes 71 of fuse set 72 do not. Similarly, the male electrodes 73 of fuse set 72 have points 21 of FIG. 1 (not shown) while the male electrodes 74 of bus connector 70 do not. Both sets of male electrodes 73 and 74 are set in holes 76 in and surrounded by a stiff, electrically insulating, compressible foam layer 77 which is designed to prevent the accidental touching of "hot" electrodes after being decompressed. Individual walls of the foam can be substituted for the foam layer 77. Bus connector 70 is cut away to show the bus bar 78 connected to cable 79.

Longer latches 62 (see FIG. 5) and locks 63 are used to force the compressed sponge layers 77 to act as a seal while keeping the two layers 77 fully compressed.

Figure 8:
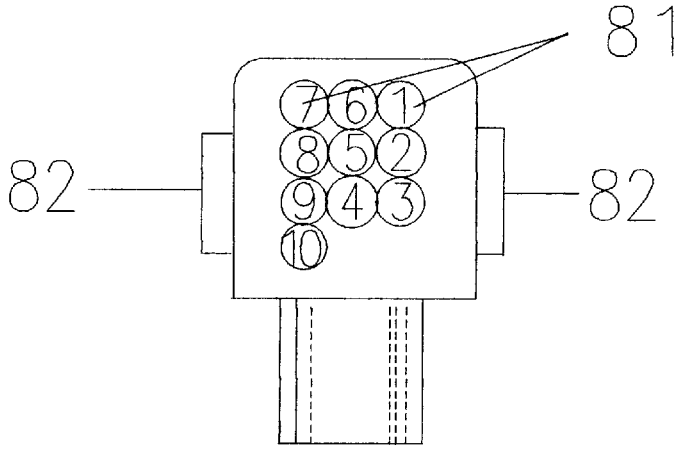
FIG. 8 depicts an end view of the circuit connector of FIGS. 6 and 7.

FIG. 8 depicts numbers 81 used for identifying the positions of the wires within circuit connector 64 of FIG. 6 and locks (not shown) used with the latches, not shown.

Figure 9:
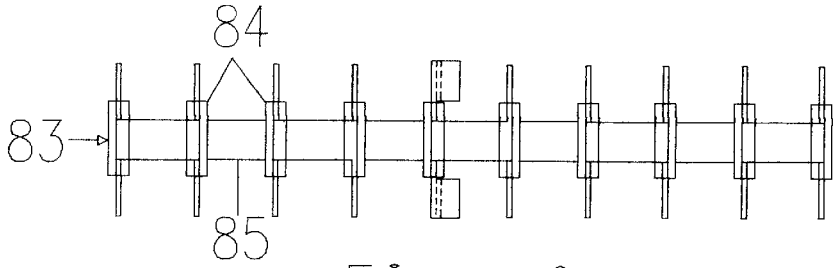
FIG. 9 depicts another form of a fuse set.

FIG. 9 teaches an all purpose fuse set 83 which can be used with aligned circuit and bus connectors with aligned fuses similar to those of FIG. 1 or with parallel positioned circuit and bus connector electrodes similar to those of FIG. 7. The set 83 is made up of individual linear fuse units 84 joined by flexible tear-away strips 85.

The Figures depict only bus circuit and communication connectors with single rows of electrodes. However, each can be made with two or more rows of electrodes. The fuse set of FIG. 9 can be made three dimensional with the addition of laterally extending strips between adjacent rows. Further, the strips can be attached at other points on the fuse units.

Figure 10:
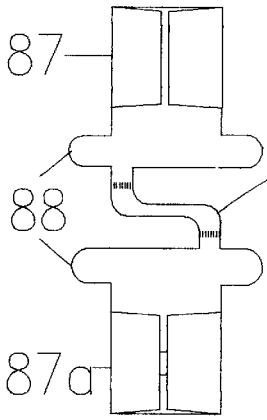
FIGS. 10 and 11 depict, respectively, a female fuse element and a half shell used in forming the female fuse units of FIG. 12.

FIG. 10 depicts a fuse element of a fuse unit 86 (see FIG. 12) made of two female electrodes 87 and 87*a,* positioning projections 88 and fuse segment 89.

Figure 11:
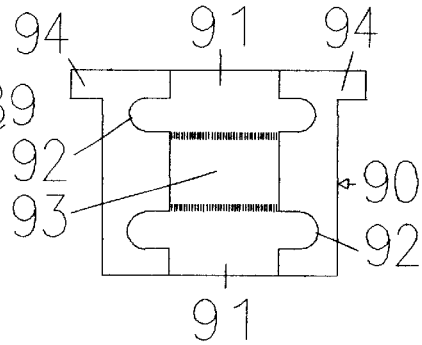

FIG. 11 depicts a half shell 90 for a fuse unit 86 with the two outlets 91 for the electrodes 87and 87*a,* recesses 92 for projections 88 and void space 93 for enclosing fuse link 89. Safety projections 94 are indicated to be capable of being removed when not needed.

Figure 12:
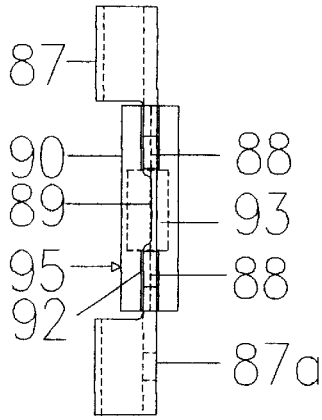
FIG. 12 depicts a side view of a female fuse unit with the half shells fused together and a vitreous anti-shock coating on one electrode.

FIG. 12 depicts a section of two half shells 90 fused or glued together to form an enclosure 95 for projections 88 (FIG. 10) seated in recesses 92, the fuse link 89 positioned within void 93 and female electrode 87 and female electrode 87*a* extend from the enclosure. Electrode 87*a* has an external coating of an electrically insulating material (not shown).

Figure 13:
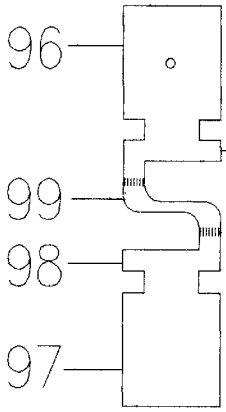
FIG. 13 depicts a side view of a fuse element of a male fuse set.

FIG. 13 teaches a fuse element made of two male electrodes 96 and 97, positioning elements 98, and fuse link 99.

Figure 14:
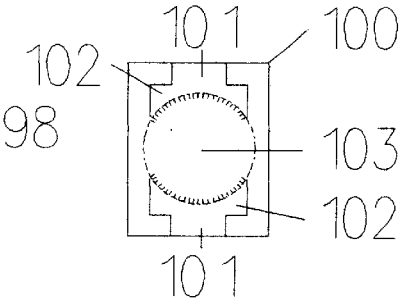
FIG. 14 is a side view of another enclosure half shell for use with the male fuse element of FIG. 13 to form male fuse units.

FIG. 14 depicts a half shell 100 for a fuse unit with outlets 101 positioning zones 102 and void space 103.

FIG. 15 provides a single fuse element 104 partially positioned within void 103 of a fuse set 105. The positioning elements 98 of FIG. 13 are within zones 102 of FIG. 14 (not shown) and the fuse link 99 is suspended within the void 103.

FIG. 16 shows a female communication connector 106 with its locks 107 and row of female electrodes 108 above a communication bridging fixture 109 with its latches 110. Fixture 109 is attached to the support panel 111 by a screw 112 and has a second set of latches 113 which interlock with the locks 114 of male communication connector 115 which has a set of complementary male electrodes 116 that mate with the row of female electrodes 108.

FIG. 17 provides a simplified diagram of an automotive firewall 120, the dash cover 121 and dash sunshade frame 122 over the dash display 123 and heater duct 124 structures. Under dash cover 121, cable supports 125 position ribbon cables 126 as they move from female circuit connectors 127 over the heater duct 124. Dash display lighting 123 (not shown) is electrically powered by cables 126 through female connectors 127 which connect to circuit board 128. Circuit board 128 powers the dash display lighting 123*a* (not shown) and the computer and control functions of control compartment 129. It also provides computer and servo control to sensors, actuators, etc. (not shown) through cable 131 from female communication connector 132 at the bottom of the dash display 123.

Sensed data from the sensors (not shown) in the engine compartment (not shown) and control data from circuit board 128 and control compartment 129 are transmitted across the firewall 120, the firewall fixture 133, and male and female connectors 134 and 135. Power is supplied to bus connector 136 by battery cable 137. The power then passes through the firewall fixture 138 and the fuse set and the circuit connector 127 and ribbon cables 126 to the circuit board 128 and compartment 129.

A computer read-out is supplied to a remote mechanic's computer through exemplary computer circuit connector 139, ribbon cable 140 and female computer socket 141. The mechanic's computer input plug 142 with its computer cable 143 is shown plugged into the socket 141 under the bottom of dust shield 144.

GENERAL DESCRIPTION OF THE INVENTION

The applications of the systems of this invention include all power systems. Examples include but are not limited to vehicular, e.g., aircraft and research submersibles; automated remote observatories, e.g., satellites; and weather stations; security systems, e.g., for home, office, remotely stored supply depots and equipment and biomedical devices, e.g., insulin pumps.

The expected primary use will be vehicle electrical systems, e.g., automotive. Higher amperage, fused systems can also be used for mobile and stationary heavy equipment. In fact, the systems can be used universally, preferably with parallel wiring systems. Other components can be sized and structured for fuses of different amperage protection. In such cases, the components will reflect the fuses of different amperage capacities in structure, heat dissipation, capacity, size and materials. The total amperage of a given system design can be easily modified to meet a desired amperage fusing capacity by shortening or lengthening the exemplary systems described or having two or more rows of fuse units or sets, circuit connectors and bus connectors. The various connectors can be connected to supports by any practical means and the fuses or fuse sets can be configured to any desired shape and locked together using the identification numbers, color, shape and fastener mechanisms utilized with computers in addition to the exemplary interlock approaches taught herein.

This invention provides safety mechanisms. These include positioned fuse assemblies where a) the components of the fusing assembly interlock to substantially reduce the likelihood of electric shock to the mechanic and user; b) the mechanic and/or use are physically blocked off from the "hot" electrodes. This result is accomplished by a) point and hole electrode to electrode interlocks and fuse or fuse set to connector interlocks and fuse and/or fuse set interlocks with bridging fixtures; b) fuse set and/or fuse unit interaction with the bridging fixtures and c) coating the exterior surface of "hot" electrodes with electrically insulating coatings and/or placing the hot electrodes within "holes" or a layer of compressible foam or within "pocket" foaming walls.

The fuses and complementary slots have a variety of configurations for "tapering", i.e., indexing. Tapered ones have any configuration that provides an upper portion that is smaller than the lower portion, e.g., the fuse of FIG. 11 which has an enclosure with projections extending from its end; the fuse set of FIG. 7 which has a conventional taper at each end; and the beveled bottom of the fuse set of FIG. 4. The same is true of their complementary slots.

The latches and locks used in the devices of this invention can be of any form ranging from the form of those utilized in FIG. 4 et seq. to spring loaded clamps which fit over ridges or shoulders on the connectors.

The electrodes utilized can be any of those presently utilized in commerce but are, preferably, with respect to female electrodes, the coiled electrodes depicted in FIG. 2, et seq.

The "points" and "holes" are not limited to just those which are shown. For example, each can have a different shape. Also, the points can be merely bulges while the corresponding hole can be a complementary depression in the electrode.

Linear fuses are generally made of a fuse element having at least two electrodes extending from opposite sides of an enclosure which is designed to hold the electrodes in place and house the fuse link. Preferably, the electrodes and fuse link are aligned in two planes but both the electrodes and enclosure can have curved or substantially square bends.

The fuses are central to the fusing assembly portions of the electrical system but safety becomes more important for dc automotive systems where voltages are expected to increase substantially. Applicant has approached the safety issue by providing positive safeguards to prevent accidental touching of "hot" electrodes.

The fuses and various electrode metals normally utilized will be those which are appropriate to their use. The plastic for the fuse enclosures, connector shells and electrode shielding sponge will be any of those used for a variety of similar usages, e.g., the plastics used in automotive fuse blocks, connectors and in plug fuses. Both the fuse elements and the connectors can form fusing assemblies having configurations which are bent at angles or with curves or in a single plane as shown.

The systems described are shown for use with bridging fixtures placed across holes in support panels, or in the absence of such panels. They can also be screwed, riveted or attached to a surface or slipped into a "holster" which has been otherwise mounted.

The manufacturer of commercial components making up the systems of this invention should design their components to meet the standards established by The Society of Automotive Engineers, Underwriters Laboratories (UL) and similar organizations and should comply with any regulations established by the government(s) and their agencies relating to the vehicles and other equipment, etc., appropriate to each system's usage. Manufacturers, marketers, buyers and users are warned to study the required standards, laws, regulations and needs pertaining to manufacturing, marketing and usage of the systems and components and to conduct such operations in a way that is safe for the environment, the manufacturer's employees, distribution personnel, mechanics and the end users on both a short and long-term basis.

What is claimed is:

1. A fusing assembly comprising at least one circuit connector having a plurality of wires connected, within a shell, to electrodes which are connectable to at least one of a plurality of linear fuses and/or at least one linear fuse set;

at least one of the plurality of linear fuse units and the at least one linear fuse set having first electrodes complementary to and connectable with the electrodes of the at least one circuit connector and second electrodes connectable to at least one bus connector and the at least one bus connector having at least one bus bar connectable to at least one wire for connection to a power source.

2. The fusing assembly of claim 1 further including a bridging fixture means for positioning the at least one circuit connector, the at least one of a plurality of the linear fuse units and the at least one linear fuse set having first electrodes complementary to and connectable with the electrodes of the at least one circuit connector and second electrodes connectable to the at least one bus connector across a hole in a support where the bridging fixture means includes at least one slot and the at least one of a plurality of fuse units and the at least one fuse set are positionable within the at least one slot and the bridging fixture means is connectable to at least one of the at least one circuit connector and to the at least one bus connector by at least one releasable interlocking mechanism.

3. The fusing assembly of claim 1 further having a plurality of latches and stops positioned for interlocking the at least one circuit connector and the at least one bus connector.

4. The fusing assembly of claim 1 wherein the bus connector means has a section in the form of a "Y" bus electrode.

5. The fusing assembly of claim 1 wherein at least one circuit connector and the at least one bus connector are interlocked by a releasable lock mechanism.

6. The fusing assembly of claim 1 further including number indicia on the outer surface of the at least one circuit connector which identifies the positions of wires within the at least one circuit connector.

7. The system of claim 1 wherein each of the plurality of linear fuse units includes at least one pair of electrodes which are continuous with a fuse link, and have positioning projections adjacent their base positioned within an enclosure having outlets for the electrodes, recesses adjacent the base of the electrodes for the containment of positioning projections and a void space enclosing the fuse link.

8. The fusing assembly of claim 1 wherein the at least one of the circuit connector, the plurality of linear fuse units, the bridging fixture and the bus connector has incorporated therein coiled female electrodes.

9. The fusing assembly of claim 1 further including a safety means which is a combination of at least one of a plurality of fuse units and at least one fuse set positioned within an enclosure which is tapered on at least one side.

10. The fusing assembly of claim 1 further including a female connector element in the form of a "Y".

11. The fusing assembly of claim 1 further including a stiff, compressible, electrically insulating layer attached to any surface of the at least one circuit connector, the at least one of a plurality of linear fuse units, the at least one linear fuse set, and at least one bus connector from which at least one electrically hot electrodes extend.

12. The fusing assembly of claim 1 wherein at least one of each of the at least one fuse unit and the at least one fuse set electrodes has one of a hole or a point and the at least one of complementary electrodes of at least one of the circuit connector and the bus connector has the other.

13. The fusing assembly of claim 1 wherein the at least one fuse set has individual fuse units joined by flexible strips.

14. The fusing assembly of claim 13 where the strips are flexible tear-away strips.

15. The fusing assembly of claim 1 wherein each of the at least one of the first and second electrodes of each of the at least one of the linear fuse units and the at least one linear fuse set has means for interlocking with, respectively, at least one complementary electrode of each of the circuit connector and the bus connector.

16. The fusing assembly of claim 15 wherein each of the means for interlocking is complimentary to the other and comprise at least one of a point and a hole interlockable with the other.

17. The fusing assembly of claim 1 further including at least one safety means.

18. The fusing assembly of claim 17 wherein the safety means is at least one of a beveled edge on at least one of the si or the bottom edges of the at least one fuse unit and the at least one fuse set and the shape of the slot(s) in the fixture is complementary to the shape of the at least one fuse unit and the at least one fuse set bevel.

19. A fusing assembly comprising at least one circuit connector having a plurality of wires connected, within a shell, to electrodes which are connectable to at least one of a plurality of linear fuses and/or at least one linear fuse set;

at least one of a plurality of linear fuse units and at least one linear fuse set having first electrodes complementary to and connectable with the electrodes of the at least one circuit connector and second electrodes connectable to the at least one bus connector, the at least one bus connector having at least one bus bar connected to at least one wire for connection to a power source.

* * * * *